US010101023B2

(12) United States Patent
Ferguson et al.

(10) Patent No.: US 10,101,023 B2
(45) Date of Patent: Oct. 16, 2018

(54) SOLID FUEL HEATING DEVICE

(71) Applicants: Robert W. Ferguson, South Royalton, VT (US); Derik K. Andors, Braintree, VT (US); Stephen F. Richardson, Randolph Center, VT (US)

(72) Inventors: Robert W. Ferguson, South Royalton, VT (US); Derik K. Andors, Braintree, VT (US); Stephen F. Richardson, Randolph Center, VT (US)

(73) Assignee: Incendia IP, LLC, South Royalton, VT (US)

( * ) Notice: Subject to any disclaimer, the term of this patent is extended or adjusted under 35 U.S.C. 154(b) by 899 days.

(21) Appl. No.: 14/261,654

(22) Filed: Apr. 25, 2014

(65) Prior Publication Data

US 2014/0318429 A1 Oct. 30, 2014

Related U.S. Application Data

(60) Provisional application No. 61/816,003, filed on Apr. 25, 2013.

(51) Int. Cl.

| | |
|---|---|
| ***F23B 10/02*** | (2011.01) |
| ***F23B 90/08*** | (2011.01) |
| ***F23B 80/04*** | (2006.01) |

(52) U.S. Cl.

CPC ..... *F23B 10/02* (2013.01); *F23B 80/04* (2013.01); *F23B 90/08* (2013.01)

(58) Field of Classification Search

CPC ..... F23B 10/02; F23B 80/04; F23B 90/08

See application file for complete search history.

(56) References Cited

U.S. PATENT DOCUMENTS 4,319,556 A * 3/1982 Schwartz ..... F23B 5/04 110/203

4,330,503 A * 5/1982 Allaire ..... F23B 5/00 110/203

(Continued)

OTHER PUBLICATIONS

International Preliminary Report on Patentability dated Sep. 2, 2015 in corresponding International Application No. PCT/US2014/035410.

(Continued)

*Primary Examiner* — Kenneth Rinehart
*Assistant Examiner* — Logan Jones
(74) *Attorney, Agent, or Firm* — Jeffrey T. Placker; Holland & Knight LLP

(57) ABSTRACT

Heating devices and methods for mitigating heating device pollution are generally described. In an example embodiment, a heating device includes a primary combustion chamber for combustion of a fuel. A first and a second secondary combustion chamber are in fluid communication with the primary combustion chamber for receiving an exhaust flow of combustion products from the primary combustion chamber and are configured for combustion of one or more combustion products received from the primary combustion chamber. The first and second secondary combustion chambers may provide parallel fluid paths from the primary combustion chamber. A secondary combustion selector is provided for selectively allowing the exhaust flow through the first and second secondary combustion chambers.

11 Claims, 4 Drawing Sheets

(56) References Cited

U.S. PATENT DOCUMENTS

| | | | | | |
|---|---|---|---|---|---|
| 4,373,507 | A * | 2/1983 | Schwartz | F23G 7/07 | 110/203 |
| 4,422,437 | A * | 12/1983 | Hirschey | F24B 1/006 | 110/210 |
| 4,476,852 | A * | 10/1984 | Lee | F23G 7/07 | 110/203 |
| 4,582,044 | A * | 4/1986 | Ferguson | F23B 5/04 | 110/211 |
| 4,582,045 | A * | 4/1986 | Dorau | F23B 90/08 | 110/203 |
| 4,646,712 | A * | 3/1987 | Ferguson | B67B 7/00 | 110/203 |
| 4,725,411 | A * | 2/1988 | Cornelison | B01D 53/9454 | 422/180 |
| 5,014,680 | A * | 5/1991 | Siemer | F23B 7/005 | 110/214 |
| 6,067,979 | A * | 5/2000 | Jaasma | F23K 3/06 | 110/116 |
| 6,968,838 | B1 * | 11/2005 | Tiegs | F23G 7/07 | 126/500 |
| 2007/0245723 | A1 * | 10/2007 | Kamoshita | B01D 53/9495 | 60/299 |

OTHER PUBLICATIONS

International Search Report for International Application No. PCT/US2014/035410 mailed from the International Searching Authority dated Sep. 2, 2014.

* cited by examiner

SOLID FUEL HEATING DEVICE

CROSS-REFERENCE TO RELATED APPLICATION

This application claims the benefit of U.S. provisional patent application Ser. No. 61/816,003, filed on Apr. 25, 2013, entitled "System for Improving Combustion Performance and Reducing Pollutant Emissions in Solid-Fuel Burning Heating Equipment," the entire disclosure of which is incorporated herein by reference.

TECHNICAL FIELD

The present disclosure generally relates to solid fuel heating devices, and more particularly relates to systems and methods for reducing pollutant emissions from solid fuel heating devices.

BACKGROUND

Solid fuel heating, and in particular, cordwood fuel heating is a long-standing approach to satisfying heating requirements. Solid fuel heating technology has improved considerably through history, particularly in the area of heating efficiency and pollution control. Burning wood, especially incomplete combustion of wood, typically results in various types of air pollution including fine particulate matter and condensable organic compounds, such as creosote. Various state and federal regulatory agencies, such as the U.S. Environment Protection Agency, have promulgated various regulations directed at restricting the allowable particulate emissions for wood-burning heating appliances in an effort to reduce the environmental and health impacts of such wood-burning heating appliances. In an increasing effort to control the environmental and health impacts associated with wood-burning heating appliances, the various enacted and/or proposed regulations are not only directed at stricter emission requirements, but also at expanding the range and types of heating appliances covered by the regulations.

Many current and prior regulations have been directed at space heaters or room heaters. New and proposed regulations seek to expand the scope of regulated appliances to include whole-house heaters, also referred to as wood-burning central heating systems. Because whole-house heaters tend to use much larger fuel loads and are typically required to operate over a much broader range of outputs, many emission control technologies that have been implemented for room heaters are not readily applicable to whole house systems. In addition to the larger fuel load capacity, whole house heaters often rely on automatic control features, such as thermostatic controls, to maintain a desired set temperature in the house. The set temperature is desirably maintained across a wide range of outside temperatures. Therefore, a whole house heater must be capable of providing a wide range of heating outputs independent from the size of the fuel load, all while maintaining a high degree of combustion efficiency.

SUMMARY

In an implementation a heating device may include a primary combustion chamber for combustion of a fuel. The heating device may include a first and a second secondary combustion chamber in fluid communication with the primary combustion chamber for receiving an exhaust flow of combustion products from the primary combustion chamber.

The first and second secondary combustion chambers may be configured for combustion of one or more combustion products received from the primary combustion chamber. The first and second secondary combustion chambers may provide parallel fluid paths from the primary combustion chamber. A secondary combustion selector may be included for selectively allowing the exhaust flow through the first and second secondary combustion chambers.

One or more of the following features may be included. The first secondary combustion chamber may support a thermal combustion process. The second secondary combustion chamber may support a catalytic combustion process. The first secondary combustion chamber may support a first catalytic combustion process having a first capacity. The second secondary combustion chamber may support a second catalytic combustion process having a second capacity.

The secondary combustion selector may include a selector plate selectively sealing engageable with an outlet of the first secondary combustion chamber and an outlet of the second secondary combustion chamber. The selector plate may be movable to a first position sealingly engaged with the outlet of the first secondary combustion chamber to prevent the exhaust flow through the first secondary combustion chamber. In the first position the selector plate may be disengaged with the outlet of the second secondary combustion chamber to permit the exhaust flow through the second secondary combustion chamber. The selector plate may be movable to a second position sealingly engaged with the outlet of the second secondary combustion chamber to prevent the exhaust flow through the second secondary combustion chamber. In the second position the selector plate may be disengaged with the outlet of the first secondary combustion chamber to permit the exhaust flow through the first secondary combustion chamber. The selector plate may be movable to a third position disengaged from the outlet of the first secondary combustion chamber and disengaged from the outlet of the second secondary combustion chamber to permit the exhaust flow through the first secondary combustion chamber and to permit the exhaust flow through the second secondary combustion chamber.

The heating device may also include an actuator coupled with the selector plate for moving the selector plate between a first position and a second position. The actuator may be configured to receive a thermostatic control signal. The actuator may also be configured to move the selector plate based upon, at least in part, the thermostatic control signal.

The heating device may also include a secondary air control assembly. The secondary air control assembly may selectively provide air to one of the first secondary combustion chamber and the second secondary combustion chamber allowing the exhaust flow therethrough. The secondary air control assembly may be coupled with the secondary combustion selector for selectively providing air to one of the first and the second secondary combustion chambers based upon, at least in part, the secondary combustion selector selectively allowing the exhaust flow through the first and second secondary combustion chambers.

The heating device may also include an exhaust collector coupled with the first and the second secondary combustion chambers for receiving the exhaust flow from each of the first and second secondary combustion chambers. The heating device may also include a heat exchanger coupled with the exhaust collector for extracting usable heat from the exhaust flow.

According to another implementation, a heating device may include a primary combustion chamber for combustion of a fuel. The heating device may also include a first and a second catalytic secondary combustion chamber. The first and second catalytic secondary combustion chambers may be in fluid communication with the primary combustion chamber for receiving an exhaust flow of combustion products from the primary combustion chamber and may be configured for catalytic combustion of one or more combustion products received from the primary combustion chamber. The first and second secondary combustion chambers may provide parallel fluid paths from the primary combustion chamber. The heating device may also include a secondary combustion selector for selectively allowing the exhaust flow through the first and second secondary combustion chambers.

One or more of the following features may be included. The first catalytic secondary combustion chamber may have a first capacity and the second catalytic combustion chamber may have a second capacity. The secondary combustion selector may selectively allow the exhaust flow through one of the first catalytic secondary combustion chamber, the second catalytic combustions chamber, and both the first catalytic secondary combustion chamber and the second secondary catalytic combustion chamber.

The secondary combustion selector may include a selector plate selectively sealing engageable with an outlet of the first catalytic secondary combustion chamber and an outlet of the second catalytic secondary combustion chamber. The selector plate may be movable to a first position sealingly engaged with the outlet of the first secondary combustion chamber to prevent the exhaust flow through the first secondary combustion chamber. In the first position, the selector plate may be disengaged with the outlet of the second secondary combustion chamber to permit the exhaust flow through the second secondary combustion chamber. The selector plate may also be movable to a second position sealingly engaged with the outlet of the second secondary combustion chamber to prevent the exhaust flow through the second secondary combustion chamber. In the second position the selector plate may be disengaged with the outlet of the first secondary combustion chamber to permit the exhaust flow through the first secondary combustion chamber. The selector plate may also be movable to a third position disengaged from the outlet of the first secondary combustion chamber and disengaged from the outlet of the second secondary combustion chamber to permit the exhaust flow through the first secondary combustion chamber and to permit the exhaust flow through the second secondary combustion chamber.

According to another implementation, a method may include providing a primary combustion chamber for at least partially combusting a solid fuel supply. The method may also include providing a first and a second secondary combustion chamber in fluid communication with the primary combustion chamber for receiving an exhaust flow of combustion products from the primary combustion chamber. The first and second secondary combustion chambers may be configured for combustion of one or more combustion products received from the primary combustion chamber. The first and second secondary combustion chambers may provide parallel fluid paths from the primary combustion chamber. The method may also include selectively directing the exhaust flow through one of the first and second secondary combustion chambers.

One or more of the following features may be included. The first and second secondary combustion chambers may include one or more of a thermal combustion chamber and a catalytic combustion chamber. Selectively directing the exhaust flow through one of the first and second secondary combustion chambers may include selectively sealingly engaging and disengaging a selector plate with an outlet associated with the first secondary combustion chamber and selectively sealingly engaging and disengaging the selector plate with an outlet associated with the second secondary combustion chamber.

The details of one or more implementations are set forth in the accompanying drawings and the description below. Other features and advantages will become apparent from the description, the drawings, and the claims.

DETAILED DESCRIPTION OF EXAMPLE EMBODIMENT

Figure 1:
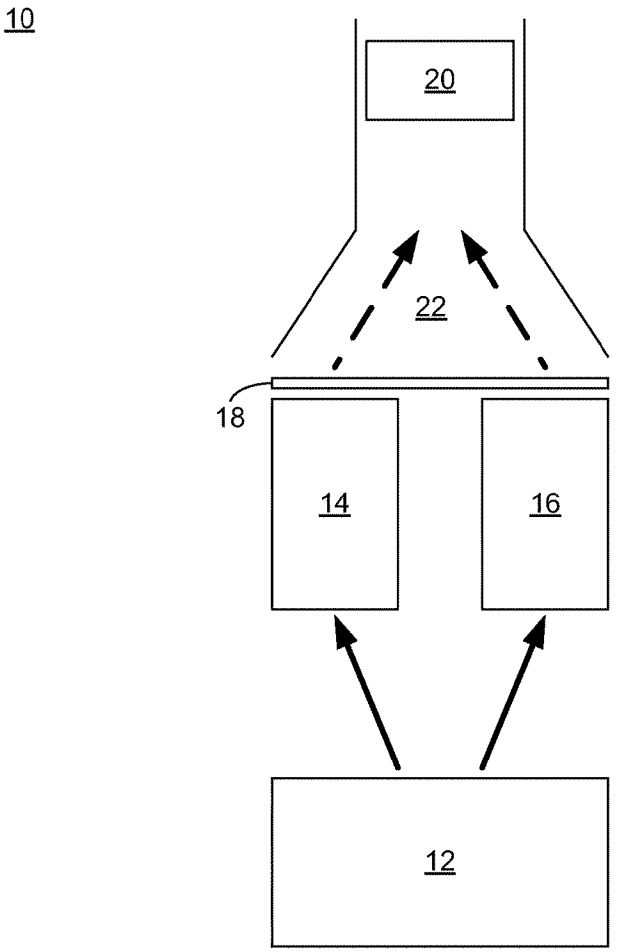
FIG. 1 schematically depicts a solid fuel heating device according to an example embodiment of the present disclosure.

In general, implementations of the present disclosure may provide efficient and clean operation of solid fuel heating appliances (herein also referred to as "heating devices"), including heating appliances that burn cordwood as a solid fuel source. In particular implementations, the present disclosure may generally provide solid fuel heating devices that may provide such efficient and clean operation over a relatively wide range of operating conditions, e.g., including wide ranges of heat outputs from the heating device. In some implementations of the present disclosure, relatively efficient and clean operation of a heating device may be achieved, at least in part, through the use of a plurality of secondary combustion systems arranged in a generally parallel configuration. The plurality of secondary combustion systems may be selectively utilized to treat an exhaust flow from the primary combustion system. In some implementations, the plurality of secondary combustions systems may be configured to manage pollutant emissions from the heating device at different output capacities of the heating device. In some embodiments, the individual secondary combustion systems may be selectively employed based upon, at least in part, the heating output capacity provided by the heating device. The ability to selectively employ the individual secondary combustion systems based upon, at least in part, the heating output capacity provided by the heating device may advantageously allow relatively clean operation of the heating device over a broad range of heating output capacities. In some implementations, the plurality of selectable parallel secondary combustion systems may be utilized in connection with a whole house solid fuel heating device that may, for example, be required to be capable of operating over a broad range of heating output capacities.

In general, a heating device according to an embodiment may include a primary combustion system that may facilitate the initial combustion, or pyrolysis, of the solid fuel, which may include cordwood, or other solid fuel source. In many circumstances, the primary combustion of the solid fuel may not result in complete combustion of the solid fuel, resulting in vaporized condensable organic materials (e.g., such as creosote) and particulate emissions in the exhaust flow from the primary combustion system. The heating device may include a plurality of secondary combustion systems, which may generally further burn (e.g., oxidize) at least a portion of the combustible constituents of the exhaust flow from the primary combustion system. In an illustrative example, a heating device may include a first and a second secondary combustion chamber (e.g., which may respectively implement a first and a second secondary combustion system or process). A secondary combustion selector may selectively allow the exhaust flow through one, or more, of the parallel secondary combustion chambers (e.g., through one or more of the first and second secondary combustion chambers). The exhaust flow through the selected one or more secondary combustions chambers may facilitate the further combustion of any combustible constituents of the exhaust flow. Such further combustion of any combustible constituents of the exhaust flow may, at least in part, reduce the quantity of vaporized condensable organic materials and/or particulate emissions in the exhaust flow from the primary combustion system.

Two commonly secondary combustion systems include thermal secondary combustion systems and catalytic secondary combustion systems. Both thermal secondary combustions systems and catalytic secondary combustion systems may, as generally describe above, facilitate the further burning, or oxidation, of combustible materials in the exhaust flow from the primary combustion of the solid fuel, e.g., which may result from the initial incomplete combustion of the solid fuel in the primary combustion chamber. Thermal secondary combustion and catalytic secondary combustion may utilized different processes and mechanisms for accomplishing the further combustion of combustible materials in the exhaust flow from the primary combustion chamber. As such, thermal secondary combustion and catalytic secondary combustion may processes may provide advantageous performance associated with different heat output capacities of the heating device, e.g., which may include a whole house heating device that may be configured to provide a broad range of heating output capacities.

In general, a thermal secondary combustion system (e.g., which may include a thermal secondary combustion chamber configured to support and/or facilitate a thermal secondary combustion process) may elevate the combustible constituents of the exhaust flow to a temperature at or above the combustion initiation temperature of the combustible constituents. A thermal secondary combustion system may often also promote turbulent mixing of the combustible constituents of the exhaust flow with a proper amount of oxygen (often in the form of fresh air) to support combustion of the combustible materials. Additionally, thermal secondary combustion systems may often seek to maintain the temperature and mixture of air necessary to support combustion of the combustible constituents for as long as practical, e.g., to maximize the amount of, and degree to which, the combustible constituents that are combusted, to thereby minimize the pollutant emissions.

Due to the varying structure of wood, and the manner in which wood undergoes primary combustion, the make-up, quality, and temperature of the combustible materials in the exhaust flow from the primary combustion may often continuously vary. As such, it may often be difficult to maintain advantageous conditions for maintaining thermal secondary combustion. As such, thermal secondary combustion may be implemented in a variety of manners to attempt to improve the performance and/or operational envelope of the thermal secondary combustion systems. For example, in some thermal secondary combustion configurations a downdraft flow path may be utilized. According to such a configuration, exhaust flow, including the various combustible constituents, may be drawn down through the fuel and underlying charcoal bed before entering a separate secondary combustion zone. Drawing the exhaust flow, including the combustible materials, through the charcoal bed may elevate the temperature of the exhaust flow (and thereby of the combustible constituents) while also consuming excess air present in exhaust flow. In various such systems, additional combustion air may be metered into the exhaust flow within the secondary combustion system (e.g., which may include a separate secondary combustion chamber) to provide an enhanced environment for the combustion of the combustible materials in the exhaust flow. In another example of a thermal secondary combustion system, the combustible materials in the exhaust flow from the primary combustion of the solid fuel may be drawn in a generally horizontal fashion through the underlying charcoal bed to elevate the temperature of the exhaust flow. The exhaust flow may then pass to the thermal secondary combustion system (e.g., which may include a separate thermal secondary combustion chamber). Additional air may be metered into the exhaust flow to support combustion of the combustible constituents of the exhaust flow.

The above-described example thermal secondary combustion systems, as well as various additional thermal secondary combustion systems and/or configurations are generally known by those having skill in the art, and are contemplated by the present disclosure. While various implementations of thermal secondary combustions systems may be employed, thermal secondary combustion systems may not necessary provide satisfactory elimination of residual combustible constituents in the exhaust flow, and may, therefore, result in unsatisfactory levels of pollutant emissions from the heating device. Such unsatisfactory results may be particularly observed under low heat output capacity conditions, e.g., in which the underlying charcoal bed may become eroded, e.g., and may not provide the necessary conditions, such as exhaust flow temperature, or the like, for achieving satisfactory thermal secondary combustion.

Catalytic secondary combustion systems may often be utilized to maintain acceptable performance for combustion of the combustible constituents of the exhaust flow under conditions that may not support satisfactory performance of thermal secondary combustion, for example when the temperature of the combustible materials in the exhaust flow are at a temperature below what may be needed to initiate thermally induced secondary combustion. For example, a catalytic secondary combustion system may utilize a catalyst material that may allow secondary combustion of the combustible materials in the exhaust flow to initiate at temperatures that may be as much as 500° F. lower than may be required to achieve satisfactory results from thermal secondary combustion. Such catalyst materials and catalytic secondary combustions systems are generally known by those having skill in the art.

Catalytic secondary combustion systems may generally allow satisfactory secondary combustion of combustible materials in the exhaust flow at temperatures below what may be typically required to support satisfactory thermal secondary combustion. However, catalytic secondary combustion systems may not provide optimum secondary combustion performance at relatively high heat output capacities for a given heating device design. For example, a catalytic element of a catalytic secondary combustion system may presents a fairly significant flow restriction to the exhaust flow of the heating device. For a given size catalytic element, flow restriction provided by the catalytic element may restrict the maximum achievable heat output capacity of the heating device, e.g., by limiting the maximum exhaust flow throughput of the heating device. Accordingly, a catalytic secondary combustion system that may be sized to provide satisfactory secondary combustion at relatively low heat output capacities of the heating device may serve to limit the maximum heat output capacity of the heating device due to the flow restriction imparted to the exhaust flow. However, reducing the flow restriction provided by the catalytic secondary combustion system to increase the maximum heat output capacity of the heating device may result in unsatisfactory performance of the catalytic secondary combustion system at relatively low heat output capacities of the heating device. Additionally, attempting to operate the heating device at a heat output capacity greater than may be supported by a given catalytic secondary combustion system may result in damage to the catalytic secondary combustion system, resulting in a decrease in performance and/or useable life of the catalytic secondary combustion system.

As generally discussed above, consistent with some embodiments, a heating device according to the present disclosure may include a plurality of secondary combustion systems (e.g., which may, in some implementations, be embodied in a plurality of secondary combustion chambers) that may generally define parallel flow paths for the exhaust flow from the primary combustion system (e.g., which may, in some implementations, be embodied in a primary combustion chamber). In some embodiments, one or more of the individual secondary combustion chambers may be configured to provide satisfactory secondary combustion performance (e.g., in terms of the degree and/or amount of secondary combustion of combustible materials in the exhaust flow) at a different heat output capacity of the heating device as compared to a another of the plurality of secondary combustion chambers. In some embodiments, the exhaust flow may be selectively routed through one or more of the secondary combustion chambers based upon, at least in part, a current and/or anticipated heat output capacity of the heating device. According to some such implementations, a heat output capacity ratio greater than 3:1 (e.g., as a ratio of the highest satisfactory heat output capacity to the lowest satisfactory heat output capacity) may be achievable, wherein a satisfactory heat output capacity may include a heat output capacity at which the satisfactory secondary combustion may be achieved to provide acceptable pollution emissions from the heating device. Accordingly, in some embodiments, the available heating output capacity operating range of the heating device, such as a whole house heating device, may be expanded to provide satisfactory operation across a broad range of outside, or environmental, temperatures.

In general, and referring also to FIG. 1, according to an illustrative example a heating device (e.g., heating device 10) may include a primary combustion chamber (e.g., primary combustion chamber 12) for combustion of a fuel, for example for primary combustion of a solid fuel such as cordwood, etc. Heating device 10 may also include a first and a second secondary combustion chamber (e.g., first secondary combustion chamber 14 and second secondary combustion chamber 16) in fluid communication with primary combustion chamber 12 for receiving an exhaust flow of combustion products from primary combustion chamber 12 (e.g., as generally indicated by the arrows between primary combustion chamber 12 and first and second secondary combustion chambers 14, 16). First and second secondary combustion chambers 14, 16 may be configured for combustion of one or more combustion products received from the primary combustion chamber (e.g., secondary combustion of combustible constituents of the exhaust flow from primary combustion chamber 12). As generally depicted, first and second secondary combustion chambers 14, 16 may provide parallel fluid paths from primary combustion chamber 12. A secondary combustion selector (e.g., secondary combustion selector 18) may be included for selectively allowing the exhaust flow through first and second secondary combustion chambers 14, 16 (e.g., as generally depicted by the broken-lined arrows extending from first and second secondary combustion chambers 14, 16). Further, heating device 10 may include a heat exchanger (e.g., heat exchanger 20) disposed within an exhaust system (e.g., exhaust system 22). Heat exchanger may include, for example, an air-to-air heat exchanger, and air-to-water heat exchanger, or similar heat exchanger, e.g., which may extract usable heat from the exhaust flow to be utilized by a heat distribution system, a water heater, and/or to be otherwise utilized.

According to an embodiment, first secondary combustion chamber 14 may include a thermal secondary combustion chamber, e.g., which may support thermal secondary combustion of combustible materials included in the exhaust flow from primary combustion chamber 12. In an embodiment, second secondary combustion chamber 16 may include a catalytic secondary combustion chamber, e.g., which may support catalytic combustion of combustible materials included in the exhaust flow from primary combustion chamber 12. In further embodiments, both first and second secondary combustion chambers 14, 16 may include catalytic secondary combustion chambers, e.g., which may support catalytic combustion of combustible materials included in the exhaust flow from primary combustion chamber 12. In one such embodiment, first secondary combustion chamber 14 may support a first catalytic combustion process having a first capacity (e.g., may provide satisfactory secondary combustion at a first heat output capacity of heating device 10), and second secondary combustion chamber 16 may support a second catalytic combustion process having a second capacity (e.g., may provide satisfactory secondary combustion at a second heat output capacity of heating device 10). In an embodiment, the first capacity and the second capacity may represent different heat output capacities of heating device 10. As such, first and second secondary combustion chambers 14, 16 may provide satisfactory secondary combustion performance at different heat output capacities of heating device 10. In further embodiments, more than two secondary combustion chambers may be utilized. According to various embodiments, the secondary combustion chambers may include thermal secondary combustion chambers, catalytic secondary combustion chambers (e.g., which may be sized for satisfactory performance at different heat output capacities of heating device 10), and/or combinations of thermal secondary combustion chambers and catalytic secondary combustion chambers.

Secondary combustion selector 18 may allow and/or prevent the exhaust flow from primary combustion chamber 12 through one or more of first and second secondary combustion chambers 14, 16. For example, in an embodiment, secondary combustion selector 18 may sealingly engage an outlet of first secondary combustion chamber 14 and/or an outlet of second secondary combustion chamber 16. When secondary combustion selector 18 is sealing engaged with the outlet of first and/or second secondary combustion chambers 14, 16, secondary combustion selector 18 may prevent the exhaust flow through the corresponding secondary combustion chamber. For example, when secondary combustion selector 18 is sealingly engaged with the outlet of first secondary combustion chamber 14, secondary combustion selector 18 may prevent and/or inhibit the exhaust flow from primary combustion chamber 12 through first secondary combustion chamber 14. Correspondingly, when secondary combustion selector 18 is disengaged with the outlet from first secondary combustion chamber 14, secondary combustion selector 18 may allow the exhaust flow through first secondary combustion chamber 14. Similar operation of secondary combustion selector 18 may be achieved with respect second secondary combustion chamber 16.

In some embodiment, secondary combustion selector 18 may independently engage and/or disengage outlets first and second secondary combustion chambers 14, 16. In some embodiments, secondary combustion selector 18 may engage and/or disengage outlets of first and second secondary combustion chambers 14, 16 in a coordinated manner. For example, in a first position secondary combustion selector 18 may sealingly engage the outlet of first secondary combustion chamber 14, and may disengage the outlet of second secondary combustion chamber 16. In a second position, secondary combustion selector 18 may disengage the outlet of first secondary combustion chamber 14, and may sealingly engage the outlet of second secondary combustion chamber 16. In some embodiments, in a third position, secondary combustion selector 18 may disengage both the outlet of first secondary combustion chamber 14 and disengage the outlet of second secondary combustion chamber 16, to thereby allow the exhaust flow through both first and second secondary combustion chamber 14, 16. Further, in an implementation including more than two secondary combustion chambers, the secondary combustion selector may be positionable to sealingly engage and/or disengage outlets of such additional secondary combustion chambers.

In the schematic depiction of FIG. 1, secondary combustion selector 18 is depicted associated with an outlet of first and second secondary combustion chambers 14, 16. In such a configuration, the secondary selector may be subject to increased temperatures and/or combustible materials. In other embodiment, the secondary combustion selector may be otherwise disposed to allow, or disallow, the exhaust flow through one or more of the secondary combustion chambers. For example, the secondary combustion selector may be associated with an inlet of one or more of the first and second secondary combustion chambers, and/or may be located at a position further downstream from the outlets of the first and second secondary combustion chambers. Further, in some embodiments, the position of the secondary combustion selector may be controlled based upon, at least in part, a control signal from a control device. In some embodiments, the control device may include, for example, a thermostatic control device. As such, the position of the secondary combustion selector may be based upon, at least in part, a current and/or anticipated heat output capacity of the heating device. Various additional and/or alternative configurations may be equally utilized.

Figure 2:
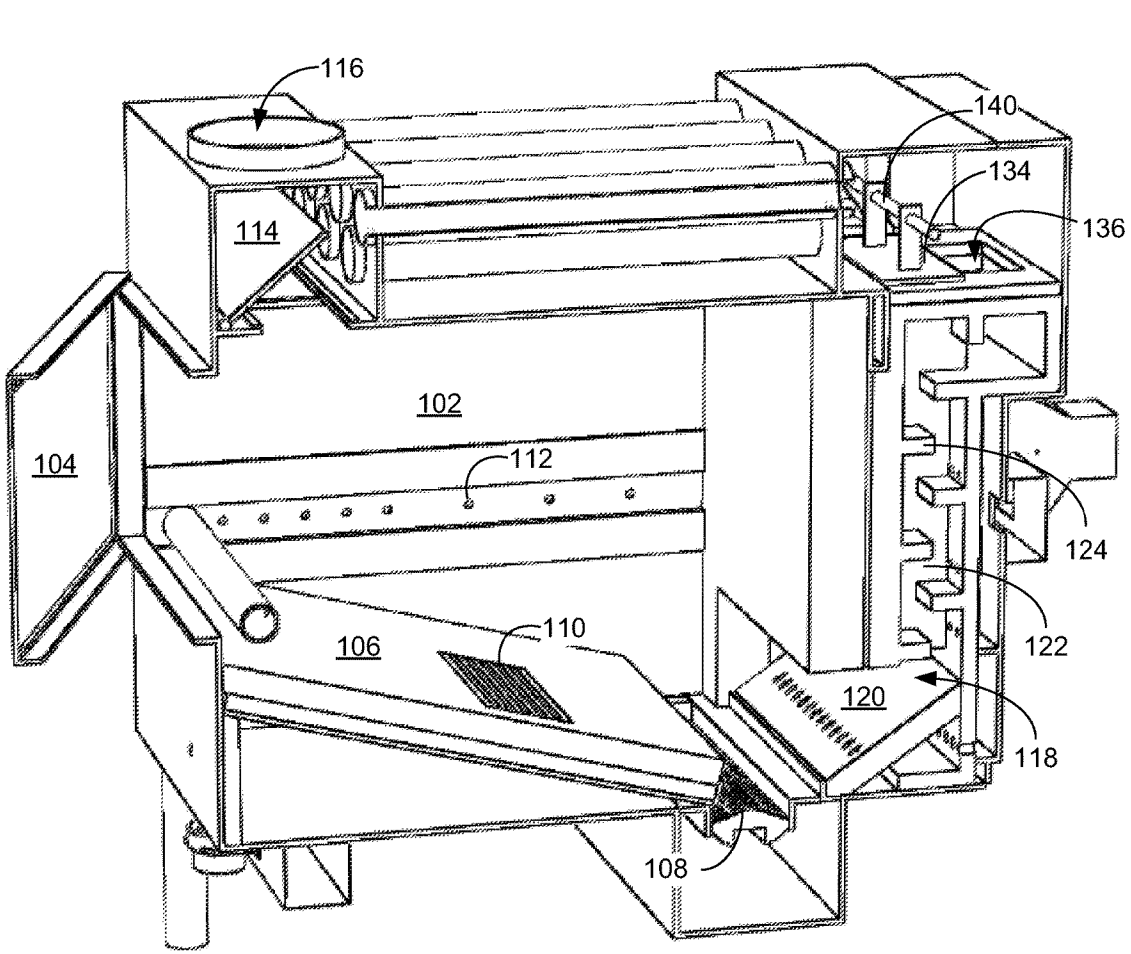
FIG. 2 is a cross-sectional view of a heating device according to an illustrative example embodiment.
Figure 3:
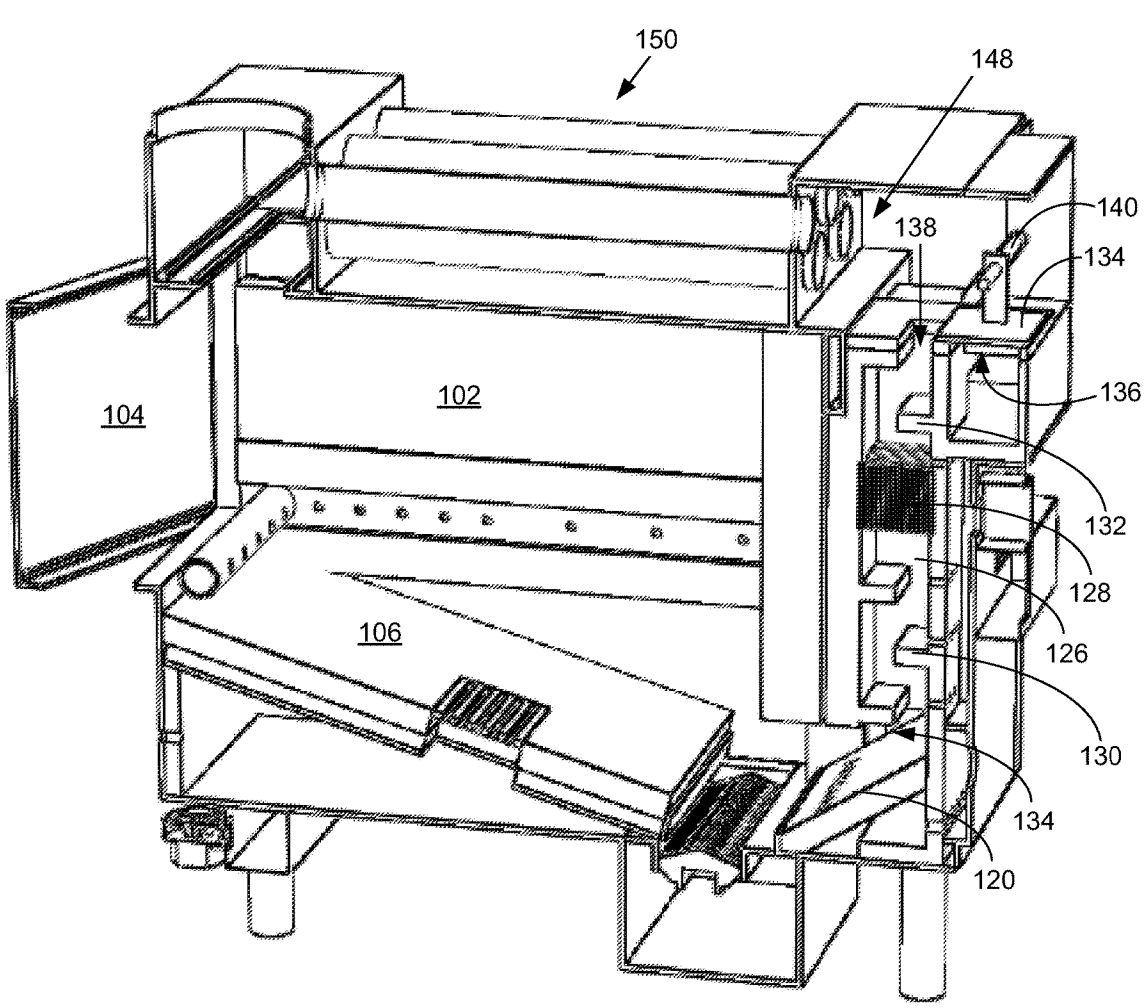
FIG. 3 is a cross-sectional view of a heating device according to an illustrative example embodiment.
Figure 4:
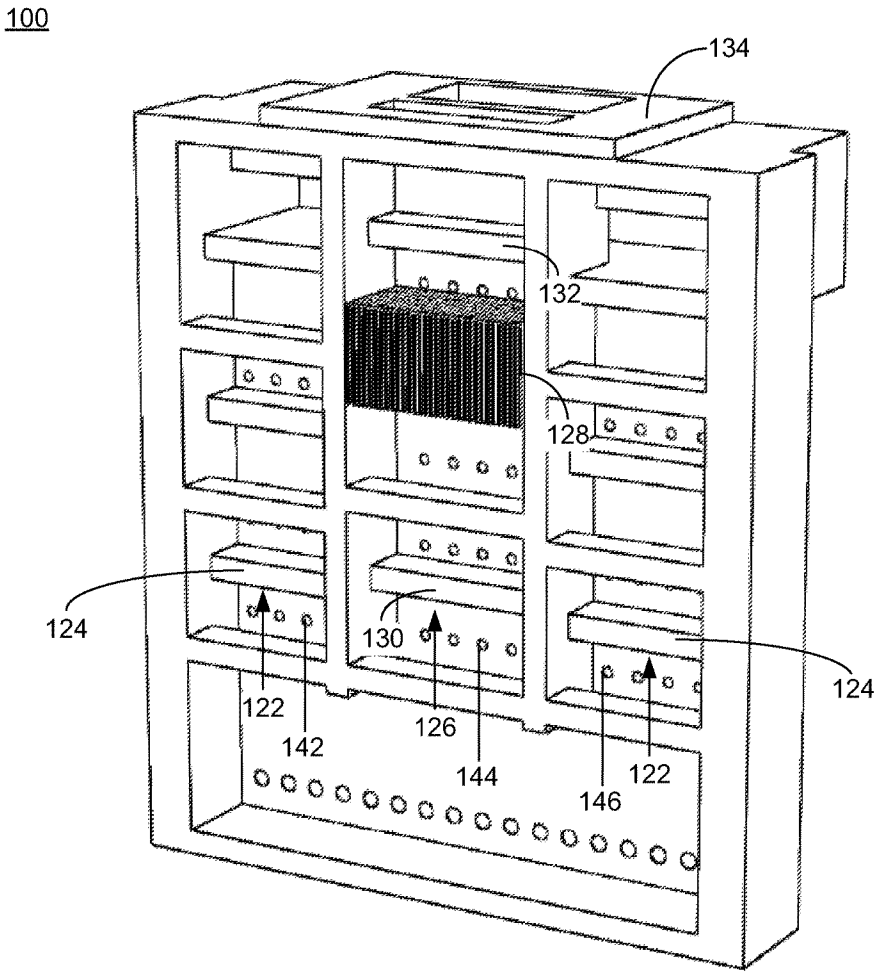
FIG. 4 is a cross-sectional view of a secondary combustion assembly of a heating device according to an illustrative example embodiment.

Referring also to FIGS. 2 through 4, an illustrative example of a heating device (e.g., heating device 100) utilizing a plurality of secondary combustion chambers, generally defining parallel exhaust flow paths, is depicted. Consistent with the illustrated example embodiment, heating device 10 may generally include a primary combustion chamber (primary combustion chamber 102). Primary combustion chamber 102 may generally include a firebox for the initial combustion, or pyrolysis, of a solid fuel, such as cord wood. Primary combustion chamber 102 may generally include a high temperature, high density refractory materials, e.g., which may withstand the necessary operating temperatures, thermal stresses, mechanical demands, and chemical conditions associated with the combustion of the solid fuel.

As is generally known, primary combustion chamber 12 may include door 104, e.g., which may facilitate loading fuel into primary combustion chamber. In some embodiments, primary combustion chamber 102 may include generally sloped floor 106, e.g., which may facilitate transport of the ash resulting from the combustion towards an ash collection system (e.g., ash collection grate 108, an ash receptacle, and the like). Additionally, primary combustion chamber may include various primary air inlets (e.g., inlets 110, 112, etc.), which may provide the necessary air supply for the primary combustion process. The air supply for the primary combustion process may include a forced air supply, such as may be generated by a blower or the like. Further, the locations and arrangements of inlets 110, 112 may be provided to facilitate the primary combustion process and/or to otherwise control or mange the primary combustion conditions. In an embodiment, bypass 114 may be provided that may allow the exhaust flow from primary combustion chamber 102 to travel directly to an exhaust system (e.g., exhaust system 116), such as a chimney. The bypass 114 may be utilized, e.g., for starting the combustion process and/or loading heating device 100 with fuel, e.g., to temporarily provide a reduce flow resistance to the exhaust flow from primary combustion chamber 102.

Heating device 100 may include a first and a second secondary combustion chamber in fluid communication with the primary combustion chamber for receiving an exhaust flow of combustion products from the primary combustion chamber. The first and second secondary combustion chambers may be configured for combustion of one or more combustion products received from the primary combustion chamber. The first and second secondary combustion chambers may provide parallel fluid paths from the primary combustion chamber. For example, as shown heating device 100 may include secondary combustion system inlet 118, which may permit the exhaust flow from primary combustion chamber 102 to one or more of the first and second secondary combustion chambers. In the illustrated embodiment, inlet 118 may be defined, at least in part, by ramp 120. Ramp 120 may, in some instances, aid in containing ash, charcoal, etc., within primary combustion chamber 102.

As shown in FIG. 2, the first secondary combustion chamber may include thermal secondary combustion chamber 122, e.g., which may support a thermal combustion process. As generally discussed above, a thermal secondary combustion process may generally provide satisfactory secondary combustion performance at a relatively high exhaust flow temperatures, e.g., as may be associated with a relatively high heat output capacity of heating device 100. In an embodiment, the thermal secondary combustion chamber may include one or more baffles (e.g., baffle 124), which may promote turbulence and/or mixing of the exhaust flow travelling through thermal secondary combustion chamber 122 (e.g., which may increase the efficiency and/or degree of secondary combustion), and/or may increase the residence time of the exhaust flow travelling through secondary combustion chamber 122 (e.g., which may provide a longer secondary combustion time, and provide and increased degree of secondary combustion).

Referring also to FIG. 3, in an embodiment, second secondary combustion chamber 126 may support a catalytic combustion process. For example, second secondary combustion chamber 126 may include catalytic combustion element 128. As is generally know, and as generally described above, catalytic combustion element 128 may reduce the necessary temperature to achieve combustion of any combustible materials included in the exhaust flow from primary combustion chamber 102. Second secondary combustion chamber 126 may include one or more baffles (e.g., baffle 130) disposed upstream of catalytic combustion element 128 and/or one or more baffles (e.g., baffle 132) disposed downstream of catalytic combustion element 128. Baffles 130, 132 may promote mixing of the exhaust flow, which may facilitate secondary combustion and/or increase the efficiency of the secondary combustion. Second secondary combustion chamber 126 may be in fluid communication with primary combustion chamber 102 via inlet 134. As shown, inlet 134 may be defined, at least in part, by ramp 120 which may, as discussed above, aid in containing ash, charcoal, etc., within primary combustion chamber 102. In other embodiments, first secondary combustion chamber 122 and second secondary combustion chamber 126 may include a common inlet form primary combustion chamber.

Referring also to FIG. 4, in an embodiment, first secondary combustion chamber 122 and second secondary combustion chamber 126 may be arranged adjacent to one another. In the illustrated embodiment, first secondary combustion chamber 122 may include two thermal combustion chambers disposed on either side of second secondary combustion chamber 126. In such a configuration, the heat received by each of first secondary combustion chamber 122 and second secondary combustion chamber 126 may preserve heat in the secondary combustion chambers 122, e.g., to facilitate efficient secondary combustion by thermal and/or catalytic secondary combustion processes. In some embodiments, first and second secondary combustion chambers 122, 126 may include a low density insulation material, e.g., which may facilitate preserving heat within the secondary combustion chambers 122, 126. In some embodiments, the use of low density insulation material may be possible due, at least in part, the low physical strength requirements of the secondary combustion chambers.

As generally discussed above, in some embodiments, the heating device may include more than one catalytic secondary combustion chambers. In some such embodiments, the various catalytic combustion chambers may be sized for satisfactory secondary combustion at different heat output capacities of the heating device. Accordingly, in addition/as an alternative to the thermal secondary combustion chamber, the heating device may include a plurality of catalytic secondary combustion chambers sized or use at different heat output capacities of the heating device.

Heating device 100 may also include a secondary combustion selector that may be included for selectively allowing the exhaust flow through the first and second secondary combustion chambers. The secondary combustion selector may include a selector plate (e.g., selector plate 134) selectively sealing engageable with an outlet of the first secondary combustion chamber and an outlet of the second secondary combustion chamber. For example, and as shown in FIG. 3, selector plate 134 may be movable to a first position sealingly engaged with the outlet of the first secondary combustion chamber (e.g., outlet 136) to prevent the exhaust flow through the first secondary combustion chamber. In the first position selector plate 134 may be disengaged with the outlet of the second secondary combustion chamber (e.g., outlet 138) to permit the exhaust flow through the second secondary combustion chamber. Referring also to FIG. 2, selector plate 134 may be movable to a second position sealingly engaged with outlet 138 of the second secondary combustion chamber to prevent the exhaust flow through the second secondary combustion chamber. In the second position selector plate 134 may be disengaged with outlet 136 of the first secondary combustion chamber to permit the exhaust flow through the first secondary combustion chamber. While not shown, in some embodiments the selector plate may also be movable to a third position disengaged from the outlet of the first secondary combustion chamber and disengaged from the outlet of the second secondary combustion chamber to permit the exhaust flow through the first secondary combustion chamber and to permit the exhaust flow through the second secondary combustion chamber. It will be appreciated that various flow control mechanisms in addition/as an alternative to a selector plate may similarly be utilized for controlling the exhaust flow through the first and second secondary combustion chambers.

In an embodiment, the heating device may also include an actuator (e.g., actuator 140) coupled with selector plate 134 for moving selector plate 134 between a first position and a second position. Actuator 140 may include, for example, a mechanical actuator, an elector mechanical actuator, a pneumatic actor, a hydraulic actuator, etc. In some embodiments, the actuator may be configured to receive a thermostatic control signal. The actuator may also be configured to move the selector plate based upon, at least in part, the thermostatic control signal. For example, the thermostatic control signal may be indicative a current and/or anticipate heat output capacity of heating device 100. In response to the thermostatic control signal, the actuator may move the selector plate to allow the exhaust flow from the primary combustion chamber through one of the first and second secondary combustion chambers that may provide satisfactory secondary combustion performance for the current and/or anticipate heat output capacity of the heating device.

In an embodiment, heating device 100 may also include a secondary air control assembly. In general, the secondary air control assembly may selectively provide air to one of the first and second secondary combustion chambers allowing the exhaust flow therethrough. For example, and referring to FIG. 4, the secondary air control assembly may include secondary air distribution openings 142, 144, 146, respectively associated with the first and second secondary combustion chambers. In an embodiment, the secondary air control assembly may be coupled with the secondary combustion selector for selectively providing air to one of the first and the second secondary combustion chambers (e.g., via secondary air distribution openings 142, 144, 146) based upon, at least in part, the secondary combustion selector selectively allowing the exhaust flow through the first and second secondary combustion chambers. The secondary air control assembly may include one or more sources of pressurized air (such as provided by a blower), and one or more valves or flow controllers to direct the flow of secondary air to a desired secondary combustion chamber. In an embodiment, providing secondary air to the secondary combustion chamber receiving the exhaust flow may facilitate the secondary combustion process in the selected secondary combustion chamber. In an embodiment, the secondary air flow control assembly may direct the secondary air flow to first and/or the second secondary combustion chamber, e.g., to prevent unwanted secondary combustion air flow to the non-selected secondary combustion chamber and may prevent flow reversal through a catalytic secondary combustion chamber when the primary combustion chamber and/or a thermal secondary combustion chamber are under positive pressure (e.g., from one or more combustion air blowers).

Heating device 100 may also include an exhaust collector (e.g., exhaust collector 148 shown in FIG. 3) coupled with the first and the second secondary combustion chambers for receiving the exhaust flow from each of the first and second secondary combustion chambers. The heating device may also include a heat exchanger (e.g, heat exchanger 150) coupled with the exhaust collector for extracting usable heat from the exhaust flow. Heat exchanger 150 may include, for example, an air-to-air heat exchanger, and air-to-water heat exchanger, or other suitable heat exchanger that may be utilized to extract usable heat form the exhaust flow. In an embodiment, heat exchanger 150 may be disposed downstream of exhaust collection chamber 148. In an embodiment, locating heat exchanger 150 downstream from collection chamber 148 may result in fewer unburned condensable pollutants (e.g., creosote, etc.) collecting on heat exchanger 150 and potentially reducing the efficiency of heat exchanger 150, and/or increasing the risk of a chimney fire, etc.

While particular embodiments have been illustrated and described, such embodiments have been provided for the purpose of example and explanation, and should not be construed as limiting the present disclosure. Various modifications and variations will be apparent to one having skill in the art. All such modifications and variations are considered to be within the scope of the present disclosure.

What is claimed is:

1. A heating device comprising:

a primary combustion chamber for combustion of a fuel;

a first and a second secondary combustion chamber in fluid communication with the primary combustion chamber for receiving an exhaust flow of combustion products from the primary combustion chamber and configured for combustion of one or more combustion products received from the primary combustion chamber, the first and second secondary combustion chambers providing parallel fluid paths from the primary combustion chamber;

a secondary combustion selector for selectively allowing the exhaust flow through the first and second secondary combustion chambers;

a secondary air control assembly coupled with the secondary combustion selector for selectively providing air to one of the first and the second secondary combustion chambers based upon, at least in part, the secondary combustion selector selectively allowing the exhaust flow through the first and second secondary combustion chambers;

a bypass in communication with the primary combustion chamber for selectively allowing the exhaust flow of combustion products to travel directly from the primary combustion chamber to an exhaust system bypassing the first and second secondary combustion chambers;

wherein the first secondary combustion chamber supports a thermal combustion process; and wherein the second secondary combustion chamber supports a catalytic combustion process.

2. The heating device according to claim 1, wherein the secondary combustion selector includes a selector plate selectively sealing engageable with an outlet of the first secondary combustion chamber and an outlet of the second secondary combustion chamber.

3. The heating device of claim 2, wherein the selector plate is movable to a first position sealingly engaged with the outlet of the first secondary combustion chamber to prevent the exhaust flow through the first secondary combustion chamber, and the selector plate is disengaged with the outlet of the second secondary combustion chamber to permit the exhaust flow through the second secondary combustion chamber.

4. The heating device of claim 2, wherein the selector plate is movable to a second position sealingly engaged with the outlet of the second secondary combustion chamber to prevent the exhaust flow through the second secondary combustion chamber, and the selector plate is disengaged with the outlet of the first secondary combustion chamber to permit the exhaust flow through the first secondary combustion chamber.

5. The heating device of claim 2, wherein the selector plate is movable to a third position disengaged from the outlet of the first secondary combustion chamber and disengaged from the outlet of the second secondary combustion chamber to permit the exhaust flow through the first secondary combustion chamber and to permit the exhaust flow through the second secondary combustion chamber.

6. The heating device according to claim 2, further comprising an actuator coupled with the selector plate for moving the selector plate between a first position and a second position.

7. The heating device according to claim 6, wherein the actuator is configured to receive a thermostatic control signal, and to move the selector plate based upon, at least in part, the thermostatic control signal.

8. The heating device of claim 1, further comprising an exhaust collector coupled with the first and the second secondary combustion chambers for receiving the exhaust flow from each of the first and second secondary combustion chambers.

9. The heating device of claim 8, further comprising a heat exchanger coupled with the exhaust collector for extracting usable heat from the exhaust flow.

10. A method comprising:

providing a primary combustion chamber for at least partially combusting a solid fuel supply;

providing a first and a second secondary combustion chamber in fluid communication with the primary combustion chamber for receiving an exhaust flow of combustion products from the primary combustion chamber and configured for combustion of one or more combustion products received from the primary combustion chamber, the first and second secondary combustion chambers providing parallel fluid paths from the primary combustion chamber;

selectively directing the exhaust flow through one of the first and second secondary combustion chambers;

selectively providing secondary air to one of the first and the second secondary combustion chambers based upon, at least in part, selectively directing the exhaust flow through one of the first and second secondary combustion chambers;

providing a bypass in communication with the primary combustion chamber for selectively allowing the exhaust flow of combustion products to travel directly from the primary combustion chamber to an exhaust system bypassing the first and second secondary combustion chambers;

wherein the first secondary combustion chamber supports a thermal combustion process; and wherein the second secondary combustion chamber supports a catalytic combustion process.

11. The method of claim 10, wherein selectively directing the exhaust flow through one of the first and second secondary combustion chambers includes selectively sealingly engaging and disengaging a selector plate with an outlet associated with the first secondary combustion chamber and selectively sealingly engaging and disengaging the selector plate with an outlet associated with the second secondary combustion chamber.

* * * * *